United States Patent [19]

Suzuki et al.

[11] Patent Number: 4,962,688

[45] Date of Patent: Oct. 16, 1990

[54] MUSICAL TONE GENERATION CONTROL APPARATUS

[75] Inventors: Hideo Suzuki; Masao Sakama, both of Hamamatsu, Japan

[73] Assignee: Yamaha Corporation, Hamamatsu, Japan

[21] Appl. No.: 353,441

[22] Filed: May 17, 1989

[30] Foreign Application Priority Data

May 18, 1988 [JP] Japan ..... 63-65708[U]
May 18, 1988 [JP] Japan ..... 63-121492
May 18, 1988 [JP] Japan ..... 63-121490

[51] Int. Cl.[5] ..... G10H 1/34
[52] U.S. Cl. ..... 84/600
[58] Field of Search ..... 84/600, 615, 622, 644, 84/653, 658, 670, 678, 692, 718, 719, 720, 723, 734, 735, 742, 743, 744, 745, 730, DIG. 24

[56] References Cited

U.S. PATENT DOCUMENTS 4,245,539 1/1981 Jones ..... 84/600
4,905,560 3/1990 Susuki et al. ..... 84/600

FOREIGN PATENT DOCUMENTS 61-196297 12/1986 Japan .

OTHER PUBLICATIONS

Published European Patent Application No. 264,872 to Hiyoshi et al.

*Primary Examiner*—W. B. Perkey
*Attorney, Agent, or Firm*—Spensley Horn Jubas & Lubitz

[57] ABSTRACT

A musical tone generation control apparatus provides at least one holding device (such as a grip device) having a shape which can be easily held by one hand of a person. This holding device further provides plural pressure sensors each capable of sensing a depression-pressure applied thereto, wherein these pressure sensors are arranged such that each pressure sensor can be easily touched and depressed by each finger of the hand of person. In addition, an angle detector can be provided in order to detect a bending angle at a joint portion of the person. Based on the combination of sensed depression-pressure and detected bending angle, musical tone control data for controlling an externally-provided musical tone generating apparatus is generated. This musical tone control data is used for controlling a key-on timing, a tone color, a tone pitch or other attributes of the musical tone.

4 Claims, 11 Drawing Sheets

| ARM DIRECTION | | ON SWITCH | | | | MUSICAL SCALE |
|---|---|---|---|---|---|---|
| LEFT | RIGHT | La | Lb | Ra | Rb | |
| UPPER | UPPER | ○ | ○ | ○ | ○ | $C^n$ |
| UPPER | MIDDLE | ○ | ○ | ○ | × | $D^n$ |
| UPPER | LOWER | ○ | ○ | × | × | $E^n$ |
| MIDDLE | UPPER | ○ | × | ○ | ○ | $F^n$ |
| MIDDLE | MIDDLE | ○ | × | ○ | × | $G^n$ |
| MIDDLE | LOWER | ○ | × | × | × | $A^n$ |
| LOWER | UPPER | × | × | ○ | ○ | $B^n$ |
| LOWER | MIDDLE | × | × | ○ | × | $C^{n+1}$ |
| LOWER | LOWER | × | × | × | × | $D^{n+1}$ |

○: ON ×: OFF

| TONE NUMBER | TONE COLOR |
|---|---|
| 0 | PIANO |
| 1 | FLUTE |
| 2 | TRUMPET |
| 3 | CLARINET |
| - - - - - - | - - - - - - |
| 7 | SAXOPHONE |

| ARM DIRECTION | | ON SWITCH | | | | POSITION NUMBER |
|---|---|---|---|---|---|---|
| LEFT | RIGHT | La | Lb | Ra | Rb | |
| UPPER | UPPER | ○ | ○ | ○ | ○ | 0 |
| UPPER | MIDDLE | ○ | ○ | ○ | × | 1 |
| UPPER | LOWER | ○ | ○ | × | × | 2 |
| MIDDLE | UPPER | ○ | × | ○ | ○ | 3 |
| MIDDLE | MIDDLE | ○ | × | ○ | × | 4 |
| MIDDLE | LOWER | ○ | × | × | × | 5 |
| LOWER | UPPER | × | × | ○ | ○ | 6 |
| LOWER | MIDDLE | × | × | ○ | × | 7 |
| LOWER | LOWER | × | × | × | × | 8 |

○: ON ×: OFF

| POSITION NO. | NOTE CODE |
|---|---|
| 0 | 0 (C) |
| 1 | 2 (D) |
| 2 | 4 (E) |
| 3 | 4 (E) |
| 4 | 5 (F) |
| 5 | 7 (G) |
| 6 | 7 (G) |
| 7 | 9 (A) |
| 8 | 11 (B) |

FIG.12

| NOTE CODE | MUSICAL SCALE |
|---|---|
| 0 | C |
| 1 | $C^{\#}$ ($D^{b}$) |
| 2 | D |
| 3 | $D^{\#}$($E^{b}$) |
| 4 | E |
| 5 | F |
| 6 | $F^{\#}$($G^{b}$) |
| 7 | G |
| 8 | $G^{\#}$($A^{b}$) |
| 9 | A |
| 10 | $A^{\#}$($B^{b}$) |
| 11 | B |

FIG.13

| ARM DIRECTION | | ON SWITCH | | | | MUSICAL SCALE |
|---|---|---|---|---|---|---|
| LEFT | RIGHT | La | Lb | Ra | Rb | |
| UPPER | UPPER | ○ | ○ | ○ | ○ | $C^n$ |
| UPPER | MIDDLE | ○ | ○ | ○ | × | $D^n$ |
| UPPER | LOWER | ○ | ○ | × | × | $E^n$ |
| MIDDLE | UPPER | ○ | × | ○ | ○ | $F^n$ |
| MIDDLE | MIDDLE | ○ | × | ○ | × | $G^n$ |
| MIDDLE | LOWER | ○ | × | × | × | $A^n$ |
| LOWER | UPPER | × | × | ○ | ○ | $B^n$ |
| LOWER | MIDDLE | × | × | ○ | × | $C^{n+1}$ |
| LOWER | LOWER | × | × | × | × | $D^{n+1}$ |

○: ON X: OFF

| | SENSOR NUMBER | FUNCTION NUMBER |
|---|---|---|
| SR1 | 0 | 0 |
| SR2 | 1 | 0 |
| SR3 | 2 | 1 |
| SR4 | 3 | 2 |
| SR5 | 4 | 3 |
| SR6 | 5 | 4 |
| SR7 | 6 | 5 |
| SL1 | 7 | 6 |
| SL2 | 8 | 7 |
| SL3 | 9 | 8 |
| SL4 | 10 | 9 |
| SL5 | 11 | 10 |
| SL6 | 12 | 11 |
| SL7 | 13 | 12 |

17a

FIG.15

MUSICAL TONE GENERATION CONTROL APPARATUS

BACKGROUND OF THE INVENTION

1. Field of the Invention

The present invention relates to a musical tone generation control apparatus, and more particularly to a musical tone generation control apparatus which controls a generation of musical tone in response to a swinging motion of player's arm, a bending motion of player's joint (or articulation) portion, a depressing motion of player's finger and the like.

2. Prior Art

It is well known that the player can perform the music by operating a keyboard and several switches of an electronic musical instrument by his hand or foot. In this case, the performed music consists of musical tones having desirable tone pitched and tone colors.

However, in the conventional electronic musical instrument using the keyboard, it is impossible to designate the tone pitch by the operation other than the operation of depressing keys by hand or foot. Therefore, there is a problem in that the performance method of the music must be limited.

In addition, the player must stand or sit in front of the electronic musical instrument in order to perform the music. Hence, it is impossible for the player to perform the electronic musical instrument with dancing or exercises.

Meanwhile, Japanese Utility Model Laid-Open Publication No. 61-196297 discloses the hand-in type electronic musical instrument having plural key switches. By operating any one of the key switches, the musical tone having the desirable tone pitch can be generated. However, this electronic musical instrument can not control the tone color of the musical tone to be generated.

SUMMARY OF THE INVENTION

It is accordingly a primary object of the present invention to provide a musical tone generation control apparatus capable of controlling the musical tone by the swinging motion of arm, bending motion of joint (or articulation) portion, depressing motion of finger and the like.

It is another object of the present invention to provide a musical tone generation control apparatus which enables the player to perform the electronic musical instrument with moving around.

In a first aspect of the present invention, there is provided a musical tone generation control apparatus comprising:

(a) holding means having a shape which can be held by one hand of a person;

(b) a plurality of depression-pressure detecting means equipped to the holding means, the depression-pressure detecting means generating a pressure signal corresponding to a depression-pressure applied thereto by each finger of the hand of the person who holds the holding means, wherein the plurality of depression-pressure detecting means include at least a first detector and a second detector;

(c) angle detecting means for generating an angle signal corresponding to a bending angle at a joint portion of the person; and (d) means for generating musical tone control data based on the pressure signal and the angle signal, the musical tone control data controlling a musical tone generating apparatus which is externally provided, wherein the first detector is used for inputting a first musical tone control parameter indicative of a key-on timing or touch information, while the second detector is used for inputting a second musical tone control parameter indicative of a tone color.

In a second aspect of the present invention, there is provided a musical tone generation control apparatus comprising:

(a) holding means having a shape which can be held by one hand of a person;

(b) a plurality of depression-pressure detecting means equipped to the holding means for generating a signal corresponding to a depression-pressure applied thereto by each finger of the hand of the person who holds the holding means;

(c) angle detecting means for generating an angle signal corresponding to a bending angle at a joint portion of the person; and (d) means for generating musical tone control data based on the signal and the angle signal, the musical tone control data controlling a musical tone generating apparatus which is externally provided.

In a third aspect of the present invention, there is provided a musical tone generation control apparatus comprising:

(a) holding means having a shape which can be held by one hand of a person;

(b) a plurality of pressure detectors equipped to the holding means, the pressure detector generating a pressure signal corresponding to a depression-pressure applied thereto by each finger of the hand of the person who holds the holding means;

(c) first means for generating musical tone control data by performing a function assigned to a depressed pressure detector within the plurality of pressure detectors;

(d) second means capable of setting a corresponding relation between each pressure detector and its function to be assigned; and (e) third means capable of changing the corresponding relation in response to an operation of the pressure detector.

BRIEF DESCRIPTION OF THE DRAWINGS

Further objects and advantages of the present invention will be apparent from the following description, reference being had to the accompanying drawings wherein a preferred embodiment of the, present invention is clearly shown.

In the drawings:

FIG. 12 shows a reference table indicating relations between position numbers and note codes, wherein this reference table is provided within a random-access memory (RAM) shown in FIG. 1;

FIG. 13 shows relations between note codes and musical scales;

FIG. 15 shows a reference table indicating relations between sensor numbers and function numbers to be set, wherein this reference table is provided within the RAM shown in FIG. 1.

DESCRIPTION OF A PREFERRED EMBODIMENT

Figure 1:
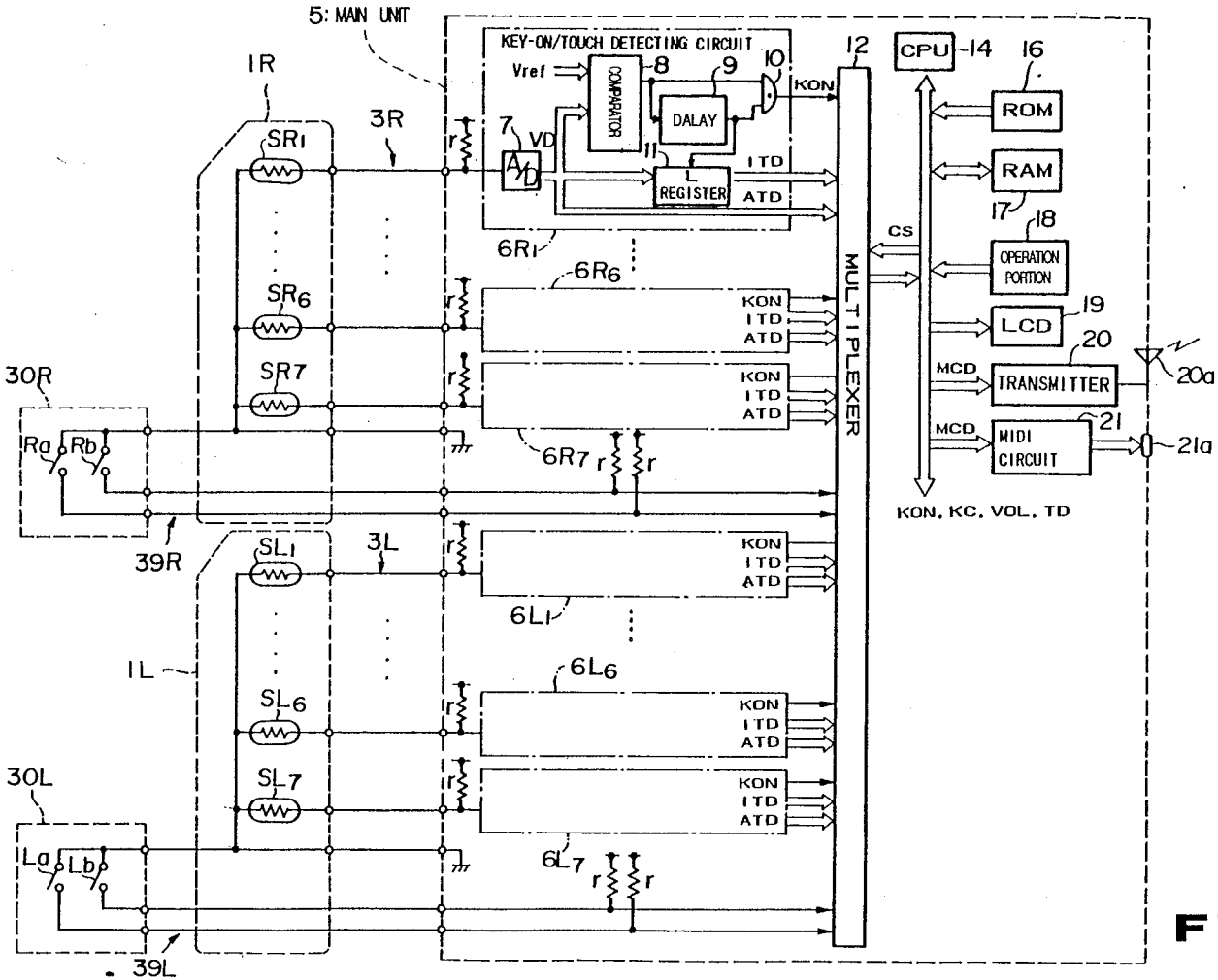
FIG. 1 is a block diagram showing a musical tone generation control apparatus according to an embodiment of the present invention.

Next, description will be given with respect to the musical tone generation control apparatus according to an embodiment of the present invention by referring to the drawings, wherein like reference characters designate like or corresponding parts throughout the several views.

[A] CONFIGURATION OF AN EMBODIMENT

Figure 2:
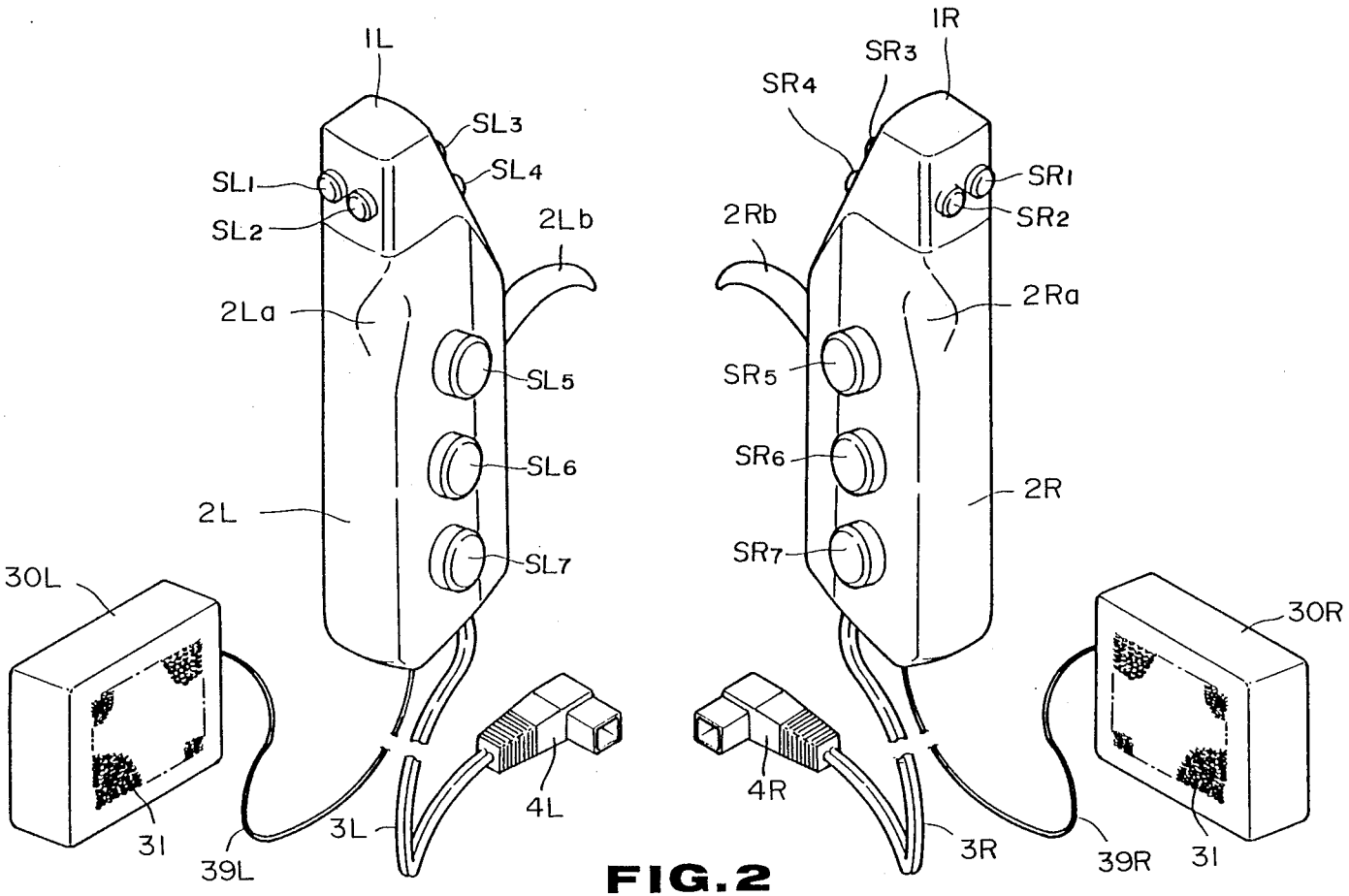
FIG. 2 shows appearances of grip devices and angle detectors which are all used in the musical tone generation control shown in FIG. 1.

FIG. 1 is a block diagram showing the whole configuration of the present embodiment, while FIG. 2 shows outer appearances of grip device 1R, 1L and angle detectors 30R, 30L.

First, description will be given with respect to the configuration of the grip device 1R, 1L. In the present embodiment, the grip device 1R is designed for a right hand, while the grip device 1L is designed for a left hand, so that these two devices are configured symmetrically with respect to each other. Therefore, detailed description will be given with respect to the grip device 1R for right hand only, and description of another grip device 1L will be omitted.

In the grip device 1R for right hand, 2R indicates a case having the shape which can be held by the right hand. In addition, when holding the case 2R, a curved portion 2R*a* is formed in order to closely fit the case 2R with the base portion between the thumb and index finger of the right hand. In addition, a projection 2R*b* to be sandwiched between the middle finger and third finger of the right hand is formed such that the case 2R will not be released from the right hand easily see FIG. 6). Seven pressure sensors SR1 to SR7 are configured into the case 2R. Each pressure sensor consists of a push-button which can be freely pushed down and then floated up by each finger and a piezoelectric element whose specific resistance is varied in response to the depressing pressure applied thereto via the push-button.

Next, description will be given with respect to the arrangement of the pressure sensors SR1 to SR7. These pressure sensors are arranged such that each can be easily depressed by each of five fingers of the right hand. More specifically, the pressure sensors SR1 and SR2 are arranged horizontally such that each can be easily depressed by the thumb of right hand; the pressure sensors SR3 and SR4 are arranged vertically such that each can be easily depressed by the index finger of right hand; and other pressure sensors SR5, SR6 and SR7 are arranged vertically such that these sensors SR5, SR6 and SR7 can be respectively depressed by the middle finger, third finger and little finger of right hand. Such arrangement makes the player to naturally operate seven pressure sensors SRI to SR7 by his five fingers.

Figure 6:
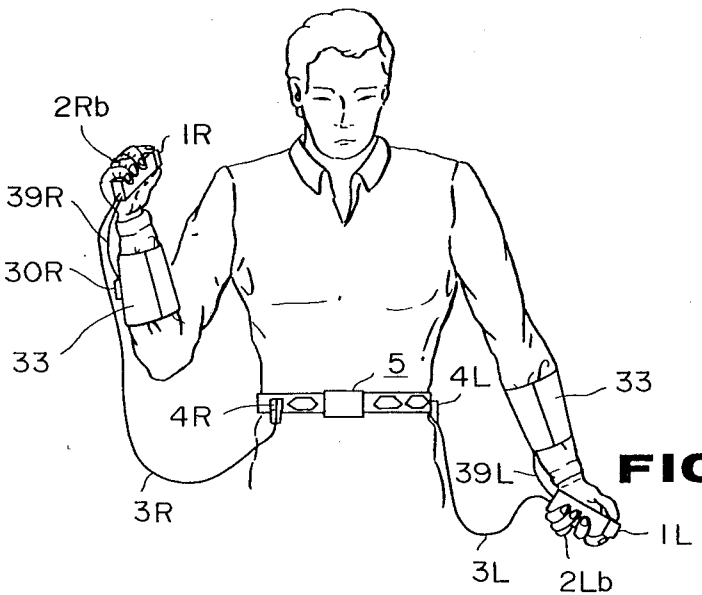
FIG. 6 is a front view of the player to whom the musical tone generation control apparatus is attached.
Figure 7:
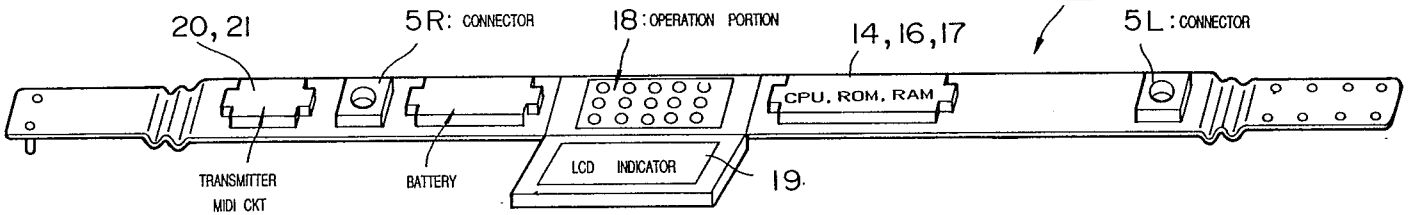
FIG. 7 is a perspective view showing an outer appearance of a belt type main unit of the musical tone generation control apparatus.

When each pressure sensor is depressed down by each finger tip, its internal piezoelectric element is effected by the depressing pressure so that its resistance is varied. These pressure sensors SRI to SR7 are connected to a belt type main unit (i.e., musical tone control data generating means) 5 via a cable 3R and a connector 4R, wherein this main unit 5 is mounted to the player's waist as shown in FIG. 6. FIG. 7 shows the outer appearance of this main unit 5.

Meanwhile, in FIG. 2, 30R indicates an angle detector for right arm, while 30L indicates an angle detector for left arm. As similar to the grip devices 1R and 1L, these angle detectors 30R and 30L are configured symmetrically with respect to each other. Therefore, description will be given with respect to the angle detector 30R only, and description of another angle detector 30L will be omitted.

Figure 3:
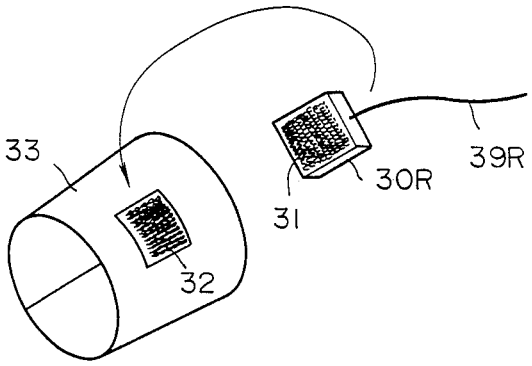
FIG. 3 is a perspective view of the angle detector to be attached to the player's arm.
Figure 4:
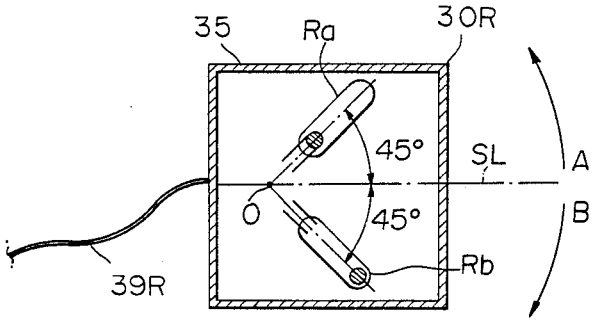
FIG. 4 shows an internal configuration of the angle detector.
Figure 5:
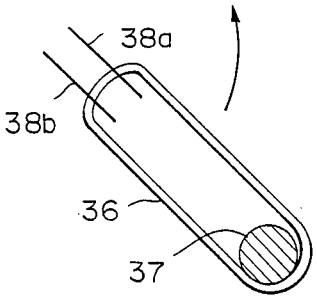
FIG. 5 shows a construction of a mercury switch which is used in the angle detector.

As shown in FIG. 3, the angle detector 30R is attached to a supporter 33 via plane fasteners 31 and 32, wherein this supporter 33 is to be attached to the player's right arm. More specifically, the male plane fastener 31 is adhered to the angle detector 30R, while the female plane fastener 32 is adhered to the supporter 33. Due to such construction, the angle detector 30R can be freely attached to and detached from the supporter 33. As shown in FIG. 4, the angle detector 30R consists of a case 35 and two mercury switches Ra and Rb, which are symmetrically arranged by 45 degrees with respect to a reference line SL on this case 35. Each mercury switch consists of a glass tube 36, mercury liquid 37 and a pair of electrodes 38*a* and 38*b* as shown in FIG. 5. More specifically, the mercury liquid 37 is enclosed within the glass tube 36 whose both edges are closely packed, and the electrodes 38*a*, 38*b* are inserted into the glass tube 36 at its one edge. In the state shown in FIG. 5, the electrodes 38*a* and 38*b* are not connected together. As this mercury switch is revolved in the direction indicated by an arrow in FIG. 5, the electrodes 38*a* and 38*b* will be connected together via the mercury liquid 37. When the angle detector 30R as configured above is revolved about the reference point (i.e., revolution center) 0 in the direction A or B as shown in FIG. 4, each of mercury switches Ra and Rb is turned on. More specifically, in the state where the reference line SL is in parallel with the ground surface (as shown in FIG. 4), the mercury switch Ra is turned on but the mercury switch Rb is turned off. When the angle detector 30R is revolved about the reference point 0 in the direction A by 45 degrees or more, the mercury switches Ra and Rb are both turned on. In contrast, when the angle detector 30R is revolved in the direction B by 45 degrees or more, the mercury switches Ra and Rb are both turned off. Then, such on/off signals of these mercury switches Ra and Rb are transmitted to the grip device IR via the cable 39R, and further transmitted to the main unit 5 via the cable 3R.

Now, back to FIG. 1, wherein first electrode terminals of the mercury switches Ra, Rb are connected in common, and then further connected to the first terminals of pressure sensors SR1 to SR7 in the grip device 1R in common. Such common connection line is further connected to the grip device 1R via the cable 3R, wherein this line is grounded. On the other hand, second terminals of the mercury switches Ra, Rb are connected into the main unit 5 via the cable 3R, then pulled up by pull-up resistors r and further connected to key-on/touch detecting circuit 6R1 to 6R7 respectively. In addition, second electrode terminals of mercury switches Ra, Rb are both led into the grip device IR via the cable 39R, and then further led into the main unit 5 via the cable 3R. In the main unit 5, these lines are pulled up by pull-up resistors r and then connected to a multiplexer 12.

Each of the key-on/touch detecting circuits 6R1 to 6R7 is designed to output a key-on signal KON, initial-touch data ITD and after-touch data ATD based on the detection voltage signal outputted from each of the pressure sensors. Herein, the key-on signal KON is outputted from the key-on/touch detecting circuit when the depressing pressure applied to the pressure sensor becomes larger than the predetermined pressure level. The initial-touch data ITD corresponds to the initial-touch when the pressure sensor is started to be depressed, i.e., the changing speed of depressing pressure which is obtained at the instance when the pressure sensor is depressed. Further, after-touch data ATD corresponds to the continuous variation of the depressing pressure until the depression of pressure sensor is ended.

Figure 8:
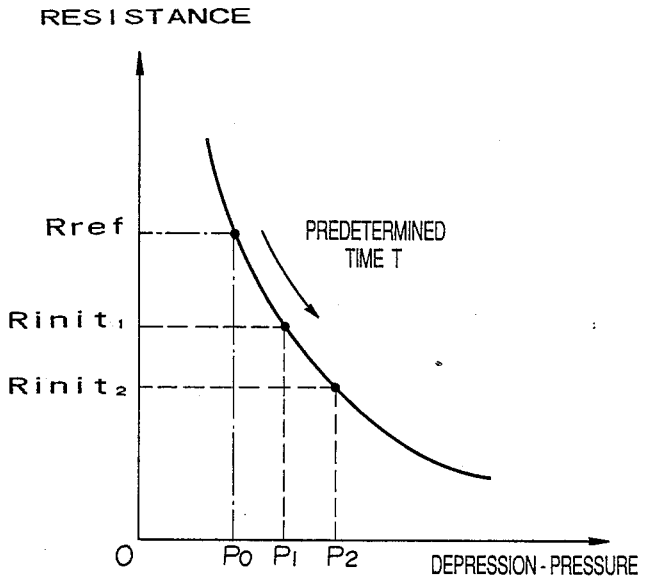
FIG. 8 is a graph showing a characteristic of a pressure sensor to be used in the embodiment.

Each key-on/touch detecting circuit consists of an analog-to-digital (A/D) converter 7, a comparator 8, a delay circuit 9, an AND gate 10 and a register 11. The A/D converter 7 converts the detection voltage from the pressure sensor into digital detection voltage data VD of predetermined bits. This detection voltage data VD is then outputted as the after-touch data ATD. In this case, as shown in FIG. 8, as the depressing pressure applied to the pressure sensor becomes larger, its resistance becomes smaller so that the detection voltage becomes smaller. For this reason, the A/D converter 7 converts the detection voltage into the digital signal, each bit of which is then inverted so that the detection voltage data VD is formed. Thus, as the depressing pressure becomes larger, the value of detection voltage data VD becomes proportionally larger. The comparator 8 compares the detection voltage data VD with predetermined reference voltage data Vref. When VD>Vref, the output of comparator 8 turns to "H" level. This output of comparator 8 is supplied to a first input of the AND gate 10. In addition, this output of comparator 8 is delayed by the delay circuit 9, and then the delayed output is supplied to a second input of the AND gate 10. Therefore, when the predetermined time T has been passed after it is detected that VD>Vref, the output of AND gate 10 turns to "H" level. Such "H" level output of AND gate 10 is outputted as the key-on signal KON. Further, the output of delay circuit 9 is also supplied to a load terminal L of the register 11. Hence, this register 11 latches the detection voltage data VD from the A/D converter 7 when the output of delay circuit 9 turns to "H" level. This latched data VD is then outputted as the initial-touch data ITD.

Next, by referring to FIG. 8, description will be given with respect to the reason why the initial-touch data ITD is given as the data latched in the register 11 when the predetermined time T has been passed after it is detected that VD>Vref.

FIG. 8 is a graph showing a relation between the depressing pressure applied to the pressure sensor and its resistance. In FIG. 8, it is supposed that, when the depressing pressure becomes equal to P0, the resistance of pressure sensor becomes equal to Rref and the detection voltage Vref also becomes equal to the reference voltage Vref. In the case where the depressing pressure is applied with relatively weak touch, i.e., in the case where the variation speed of depressing pressure is relatively slow, the depressing pressure becomes equal to P1 so that the resistance of pressure sensor becomes equal to Rinit1 after the predetermined time T has been passed. In contrast, in the case where the depressing pressure is applied with relatively strong touch, i.e., in the case where the variation speed of depressing pressure is relatively fast, the depressing pressure becomes equal to P2 (>P1) so that the resistance of pressure sensor becomes equal to Rinit2 (<Rinit1) after the predetermined time T has been passed. As described heretofore, the resistance of pressure sensor which is obtained when the predetermined time T has been passed after the depressing pressure P0 exceeds over P0 depends on the touch intensity. In short, the resistance Rinit2 is obtained if the touch is strong, while the resistance Rinit1 is obtained if the touch is weak. In addition, the detection voltage data VD outputted from the A/D converter 7 corresponds to the resistance of pressure sensor. Thus, by latching this detection voltage VD in the register 11, the initial touch data ITD can be obtained.

The above-mentioned key-on/touch detecting circuits 6R1 to 6R7 are provided with respect to the pressure sensors SR1 to SR7 of the grip device 1R for right hand. Similarly, other key-on/touch detecting circuits 6L1 to 6L7 each having the same configuration of the above-mentioned circuits 6R1 to 6R7 are also provided with respect to the pressure sensors SL1 to SL7 of the grip device 1L for left hand. Each of these key-on/touch detecting circuits 6R1 to 6R7, 6L1 to 6L7 outputs the key-on signal, initial-touch data ITD and after-touch data ATD to the multiplexer 12.

The multiplexer 12 selects one group data consisting of the key-on signal KON, initial-touch data ITD and after-touch data ATD or selects one of on/off signals (hereinafter, referred to angle data) of mercury switches Ra, Rb, La, Lb within the angle detectors 30R, 30L based on a channel select signal CS supplied to a select terminal thereof. Then, such selected data is outputted. Next, 14 indicates a central processing unit (CPU), 16 indicates a read-only memory (ROM) for storing programs used in the CPU 14, and 17 indicates a random-access memory RAM) which is used as the working area. The CPU 14 sequentially varies the channel select signal CS to thereby scan the output data of key-on/touch detecting circuits 6R1 to 6R7, 6L1 to 6L7 and the angle data from the mercury switches Ra, Rb, La, Lb with high speed. Then, the key-on signal KON, initial-touch data ITD, after-touch data ATD, angle data to be obtained are sequentially transferred to the RAM 17. Based on these data, the CPU 14 generates key code data KC for designating the tone pitch, tone volume data VOL for designating the tone volume and tone color designating data TD for designating the tone color. Herein, all of the key-on signal KON, key code data KC, tone volume data VOL and tone color designating data TD will be referred to musical tone control data MCD.

An operation portion 18 includes plural push switches (see FIG. 7) and a encoder which encodes the outputs of push switches, whereby the encoded outputs of push switches are supplied to the CPU 14. Further, 19 indicates a liquid crystal display LCD (see FIG. 7), and 20 indicates a transmitter which transmits the musical tone control data MCD from the CPU 14 with the carrier wave via an antenna 20*a*. Furthermore, a MIDI circuit 21 converts the musical tone control data MCD into the data of musical instrument digital interface (MIDI) standard, which is then outputted to the external device via an output terminal 21*a*.

[B] OPERATION OF AN EMBODIMENT

Next, description will be given with respect to the operation of the musical tone generation control apparatus whose configuration is described above.

First, in order to perform the music, the player mounts the main unit 5 on his waist as shown in FIG. 6. Then, the player connects the connectors 4R, 4L to the corresponding connectors 5R, 5L of the main unit 5 (see FIG. 7), wherein the connectors 4R, 4L are provided at the tip edges of the cables 3R, 3L which extend from the grip device 1R, 1L respectively. Further, in order to drive the musical tone generating apparatus by wire, the musical tone generating apparatus must be connected to the output terminal 21 by the cable. Thereafter, the player turns on power switches (not shown) provided at the main unit 5 and musical tone generating apparatus. Next, the player operates the push switches of the operation portion 18 to thereby designate the method of transmitting the data to the musical tone generation apparatus, i.e., by wire or by wireless. Moreover, the player executes the function assignment for assigning desirable functions to the pressure sensors SR1 to SR7, SL1 to SL7 of the grip devices 1R, 1L and the mercury switches Ra, Rb, La, Lb of the angle detectors 30R, 30L.

Figure 9:
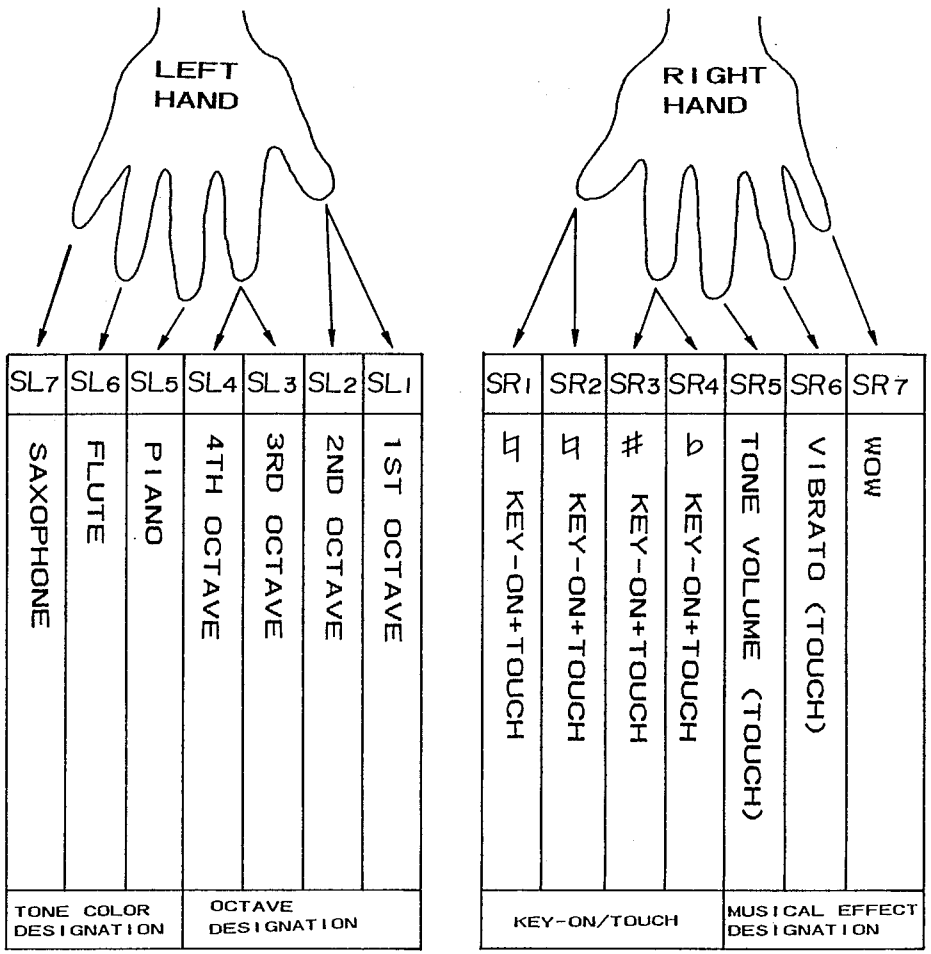
FIG. 9 shows an example of function assignment with respect to each pressure sensor and each mercury switch.

Herein, as shown in FIG. 9, the key-on and touch intensity is designated based on the outputs of pressure sensors SRI to SR4 in the grip device 1R; the tone volume, vibrato intensity and wow-on or wow-off is designated based on the outputs of pressure sensors SR5 to SR7 respectively; one of 1st to 4th octaves is designated based on the outputs of pressure sensors SL1 to SL4 of the grip device 1L; and the tone color is designated based on the outputs of pressure sensors SL5 to SL7. Further, based on the combination of on/off states of the mercury switches Ra, Rb, La, Lb in the angle detectors 30R, 30L, one of musical scales $C^n$, $D^n$, . . . , $B^n$, $C^{n+1}$, $D^{n+1}$ is designated. Such function assignment can be arbitrarily set by the player by operating the push switches of the operation portion 18.

Next, the player attaches the angle detectors 30R, 30L at his right and left arms respectively via the supporter 33. Then, the player holds the grip device 1R by his right hand and also holds the grip device 1L by his left hand. By operating the push switch for designating the start timing within the operation portion 18, the performance is to be started. Thereafter, the CPU 14 obtains the key-on signal KON, initial-touch data ITD, after-touch data ATD from the key-on/touch detecting circuits 6R1 to 6R7, 6L1 to 6L7 and the angle data from the angle detectors 30R, 30L, which are then sequentially sent to the RAM 58. Based on the sent data, the CPU 14 forms the musical tone control data MCD, which is then outputted to the MIDI circuit 21. The MIDI circuit 21 converts the data MCD into the data of MIDI standard, which is then outputted to the output terminal 21*a*. Such data of MIDI standard will be supplied to the external musical tone generating apparatus via the connection cable (not shown). Thus, the musical tone generating apparatus forms the musical tone corresponding to the data of MIDI standard to be supplied thereto, and such musical tone is to be generated by the speaker.

In this case, several functions as shown in FIG. 9 are assigned to the pressure sensors SR1 to SR7, SL1 to SL7 of the grip devices 1R, 1L and the mercury switches Ra, Rb, La, Lb of the angle detectors 30R, 30L. Hence, for example, the musical scale "$G^n$" is designated to the state where the player stretches his both arms horizontally (i.e., the state as shown in FIG. 4 where the mercury switches Ra and La are turned on); "first octave" is designated by depressing the pressure sensor S11 by his left thumb; and, tone color of "saxophone" is designated by depressing the pressure sensor SL7 by his left little finger. In such state, when the pressure sensor SR1 is depressed by the right thumb, it is possible to obtain the musical tone having the touch corresponding to the depressing pressure applied to the pressure sensor SR1 from the musical tone generating apparatus, wherein this musical tone has the tone color of saxophone and the musical scale of $G^1$. Next, when the pressure sensor SR3 is further depressed by the right index finger, it is possible to obtain the musical tone having the touch corresponding to the depressing pressure applied to SR3, wherein this musical tone has the musical scale which is higher than $G^1$ by a half tone. On the other hand, when the pressure sensor SL4 is depressed by the right index finger, it is possible to obtain the musical tone having the touch corresponding to the depressing pressure applied to SL4, wherein this musical tone has the musical scale which is lower than $G^1$ by a half tone. Meanwhile, when the pressure sensor SR5 is depressed by the right middle finger, the tone volume is varied in response to the depressing pressure of SR5; when the pressure sensor SR6 is depressed by the right third finger, the intensity of vibrato is varied in response to the depressing pressure of SR6; and when the pressure sensor SR7 is depressed by the right little finger, the wow-effect can be applied to the musical tone to be generated.

In the present embodiment, while any one of the pressure sensors SL1 to SL4 for designating the octave and other pressure sensors SL5 to SL7 is depressed, the CPU 14 judges such depression valid. Incidentally, it is possible to redesign the present embodiment such that, once any one of the pressure sensors SL1 to SL7 is depressed, it is possible to hold such designation for a while.

In the case where "wireless" is selected as the method of transmitting the data to the musical tone generating apparatus, the musical tone control data MCD is supplied to the transmitter 20. The LCD 19 indicates the operation contents of the operation portion 18.

[C] MODIFIED EXAMPLES OF THE PRESENT EMBODIMENT (1) First Modified Example

Figure 10:
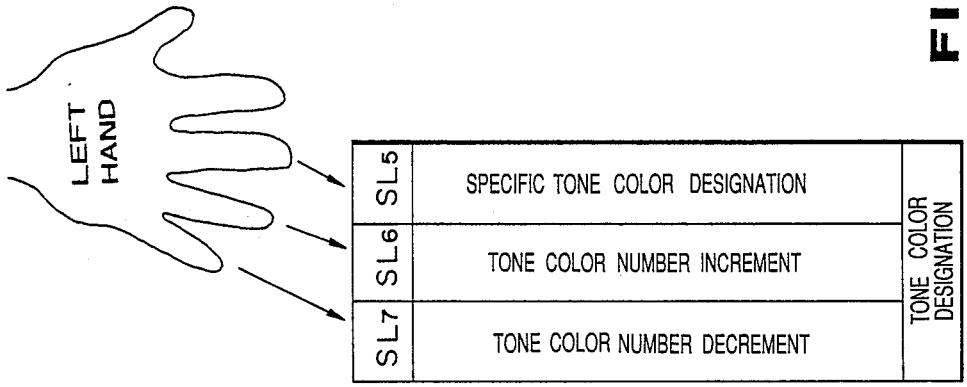
FIG. 10 shows a modified example of function assignment with respect to each pressure sensor.

Next, description will be given with respect to the first modified example of the present embodiment by referring to FIG. 10. FIG. 10 indicates the function assignment for the pressure sensors SL5 to SL7, whereas the function assignment for other pressure sensors is identical to that as shown in FIG. 9.

In the present embodiment described before, predetermined three kinds of tone colors (i.e., piano, flute, saxophone) are assigned to three pressure sensors SL5 to SL7 respectively in advance. In contrast, in this example, tone color numbers 0 to 7 are predetermined in order to designate any one of eight tone colors (i.e., piano, flute, trumpet, ..., saxophone), wherein any one of these tone color numbers can be arbitrarily designated by use of three pressure sensors SL5 to SL7. Hence, the ROM 16 additionally stores the programs for executing such tone color designating function which will be described later. For example, at the arrival timing of the key-on signal KON based on the output of pressure sensor SL5, the CPU 14 sets the tone color number "2" (corresponding to the specific tone color of trumpet) in the tone color number storing area within the RAM 17. Every time the key-on signal KON based on the output of pressure sensor SL6 is arrived, the CPU 14 increments the tone color number set in the tone color number storing area. On the other hand, every time the key-on signal KON based on the output of pressure sensor SL7 is arrived, the CPU 14 decrements the tone color number. Thus, every time the pressure sensor SL6 is depressed by the left third finger, the tone color number set in the tone color number storing area is varied as 0, 1, 2, . . . , 7, 0 in the circulating manner. On the other hand, every time the pressure sensor SL7 is depressed by the left little finger, the tone color number is varied as 7, 6, 5, . . . , 0, 7 in the circulating manner. In response to the tone color number to be varied, the tone color of the musical tone to be generated from the speaker must be varied. When both of the pressure sensors SL6 and SL7 are simultaneously depressed, the tone color number is initialized to "0".

Incidentally, the function assignment for the pressure sensors SR1 to SR7 and SL1 to SL7 is not limited to that as described in the above example. It is possible to further redesign this example such that the player can arbitrarily set the function assignment by operating the push switch in the operation portion 18. Instead of the angle detectors 30R, 30L using the mercury switches Ra, Rb, La, Lb for detecting the swinging angle of arm, it is possible to use the variable resistor and rotar encoder by which the bending angle of elbow joint portion is detected.

(2) Second Modified Example

Figure 11:
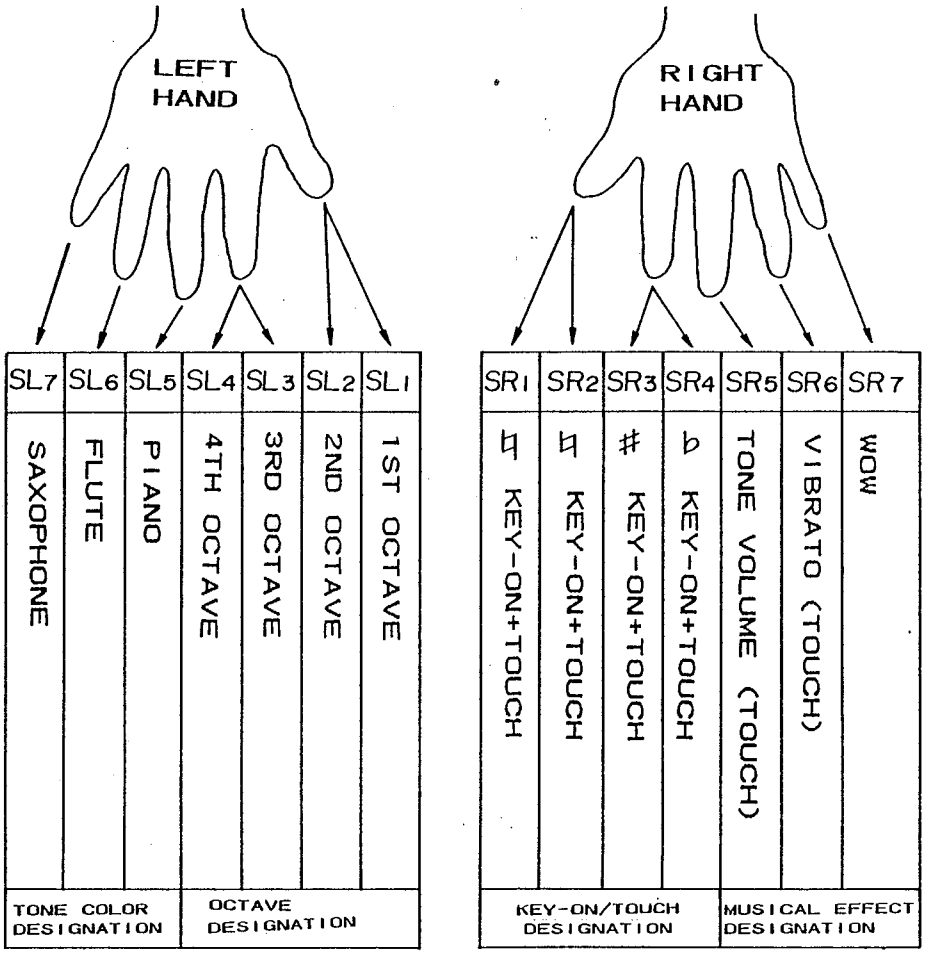
FIG. 11 shows another example of function assignment corresponding to that of FIG. 9.

Next, description will be given with respect to the second modified example by referring to FIGS. 11 to 13. FIG. 11 is similar to FIG. 9 but the position number, hence, description thereof will be omitted.

This position number which varies from "0" to "8" is based on the outputs of angle detectors 30R, 30L corresponding to the swinging angles of arms. The relations between this position numbers and the tone pitches to be generated are initialized as shown in FIG. 12. In order to change such relations, the following operations must be done.

First, the player operates the mode setting switch provided in the operation portion 18 to thereby set the tone pitch assigning mode. When this mode is set, the CPU 14 displays the contents of table 17*a* stored in the RAM 17 (see FIG. 12) on the LCD 19. Next, the player depresses the pressure sensor SR1 or SR2 to thereby set the tone pitch assignment.

For example, in the state where the player swings up his both arms (so that all of mercury switches La, Lb, Ra, Rb are turned on) and then designates the position number "0", the player depresses the pressure sensor SR1 or SR2 which is originally used for designating the key-on timing. Every time this pressure sensor is depressed by one time, the CPU 14 increments the note code corresponding to the position number "0" in the reference table 17*a* as shown in FIG. 12. Thus, the note code corresponding to the position number "0" is raised by a half musical scale as "0", "1", "2", . . . Then, the changed table 17*a* is displayed on the LCD 19. Similarly thereafter, any one of the position numbers "1" to "8" is designated by changing the directions of both arms, and then the player depresses the pressure sensor SR1 or SR2 by desirable times to thereby set the desirable tone pitch assignment. Incidentally, when the note code reaches at "12", it is automatically returned to "0".

After the above-mentioned tone pitch assignment is completed, the player changes the present mode to the normal performance mode by operating the mode setting switch.

For example, in the state where the relations between the position numbers and tone pitches are initialized as shown in FIG. 12, the player stretches his both arms horizontally (so that the mercury switches Ra and La are turned on) to thereby designate the position number "4". At this time, the CPU 14 recognizes the note code "5" from the reference table 17*a*, thus it is recognized that the musical scale "Fn" corresponding to this note code "5" is designated. Next, the player depresses the pressure sensor SL1 by his left thumb to thereby designate the "first octave"; and then depresses the pressure sensor SL7 by his left little finger to thereby designate the tone color of "saxophone". In this state, when the player depresses the pressure sensor SR1 by his right thumb, the musical tone generating apparatus generates the musical tone having the touch corresponding to the depressing pressure of SR1, tone color of saxophone and musical scale $F^1$1. Thereafter, when the player further depresses the pressure sensor SR3 by his right index finger, the musical tone generating apparatus generates the musical tone having the touch corresponding to the depressing pressure of SR3 and the musical scale which is higher than $F^1$ by a half tone. On the other hand, when the player depresses the pressure sensor SL4 by his right index finger, the musical tone generating apparatus generates the musical tone having the touch corresponding to the depression pressure of SL4 and the musical scale $E^1$ which is lower than $F^1$ by a half tone.

Incidentally, the method of setting the tone pitch assignment is not limited to that of this example. For example, it is possible to raise the note code by a half tone (i.e., increment the note code by "+1") in response to the depression of SR3 or lower the note code by a half tone (i.e., decrement the note code by "1") in response to the depression of SR4. Then, in order to assure the note code to be presently set, the musical tone generating apparatus may generate the musical tone in response to the depression of pressure sensor SR1 or SR2. In addition, it is possible to set the note code which is larger than one octave in the table 17*a*.

(3) Third Modified Example

Figure 14:
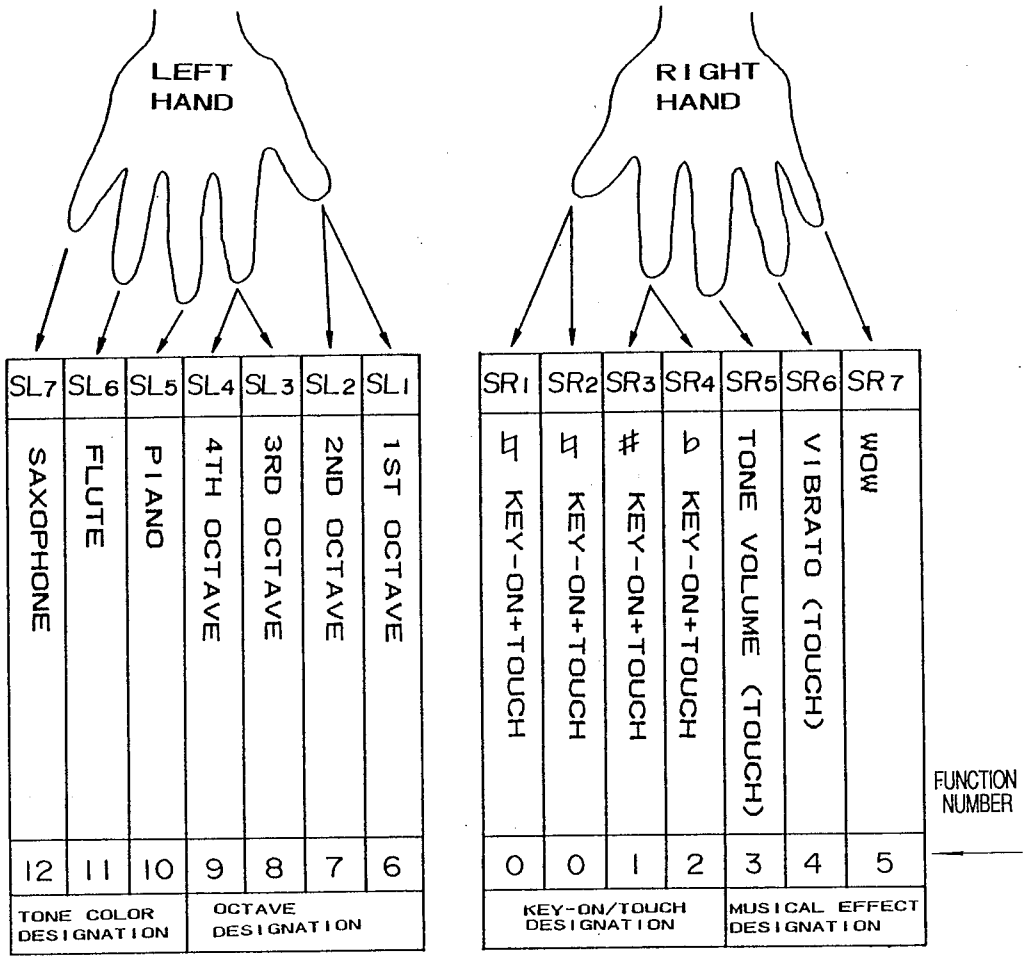
FIG. 14 shows still another example of function assignment corresponding to that of FIG. 9.

Next, description will be given with respect to the third modified example by referring to FIGS. 14 and 15. FIG. 14 is similar to FIG. 9 but the function number, hence description thereof will be omitted.

First, the player operates the mode setting switch to thereby set the sensor function setting mode. When this mode is set, the CPU 14 displays the contents of table 17*a* (see FIG. 15) on the LCD 19. Next, the player operates the pressure sensors to thereby set the desirable functions. For example, in order to set the function "2" to the pressure sensor SR1, the player depresses the pressure sensor SR1 twice. When this pressure sensor SR1 is depressed by one time, the CPU 14 detects such depression so that it increments the function number corresponding to the sensor number "0" in the table 17*a* within the RAM 17, whereby the LCD 19 changes its display. Thus, the function number "1" is set corresponding to the sensor number "0". The LCD 19 displays the changed contents of table 17*a*. Next, when the pressure sensor SR1 is additionally depressed, the function number "2" is set corresponding to the sensor number "0". Similarly, in order to set the function number "5" to the pressure sensor SR3, the pressure sensor SR3 is depressed by four times. Thus, as similar to the case of function number "2", the function number "5" corresponding to the sensor number "2" is set in the table 17*a*. Similarly thereafter, the desirable function number is set to each pressure sensor. Incidentally, when the function number reaches at "13", it is automatically returned to "0".

In the initial state, the functions as shown in FIG. 14 are set to the pressure sensors SR1 to SR7, SL1 to SL7 of the grip devices 1R, 1L. In this initial state, for example, when the player stretches his both arms horizontally (so that the mercury switches Ra and La are turned on), the musical scale "$G^n$" is designated. Then, the player depresses the pressure sensor SL1 to thereby designate the "first octave"; and he also depresses the pressure sensor SL7 to thereby designate the tone color of "saxophone". In this state, when the player depresses the pressure sensor SR1 by his right thumb, the musical tone generating apparatus generates the musical tone having the touch corresponding to the depressing pressure of SR1, the tone color of saxophone and the musical scale $G^1$. Next, when the player further depresses the pressure sensor SR3 by his right index finger, the musical tone generating apparatus generates the musical tone having the touch corresponding to the depressing pressure of SR3 and the musical scale which is higher than $G^1$ by a half tone. On the other hand, when the player depresses the pressure sensor SL4 by his right index finger, it is possible to obtain the musical tone having the touch corresponding to the depressing pressure of SL4 and the musical scale which is lower than $G^1$ by a half tone.

In the above-mentioned process, the CPU 14 detects the function number corresponding to the operated pressure sensor from the table 17*a* when the pressure sensor is depressed so that the key-on signal KON thereof takes the value "1". Next, the CPU 14 executes the process which is predetermined in correspondence with the detected function number. For example, when the pressure sensor SL7 is depressed, the CPU 14 detects the function number "12" from the table 17*a*, so that the process corresponding to this function number "12" is executed. In short, the tone color of saxophone is set.

This invention may be practiced or embodied in still other ways without departing from the spirit or essential character thereof as described heretofore. Therefore, the preferred embodiment and its modified examples are illustrative and not restrictive, the scope of the invention being indicated by the appended claims and all variations which come within the meaning of the claims are intended to be embraced therein.

What is claimed is:

1. A musical tone generation control apparatus comprising:

(a) holding means having a shape which can be held by one hand of a person;

(b) a plurality of depression-pressure detecting means equipped to said holding means, said depression-pressure detecting means generating a pressure signal corresponding to a depression-pressure applied thereto by each finger of the hand of the person who holds said holding means, wherein said plurality of depression-pressure detecting means include at least a first detector and a second detector;

(c) angle detecting means for generating an angle signal corresponding to a bending angle at a joint portion of the person; and (d) means for generating musical tone control data based on said pressure signal and said angle signal, said musical tone control data controlling musical tone generating apparatus which is externally provided, wherein said first detector is used for inputting a first musical tone control parameter indicative of a key-on timing or touch information, while said second detector is used for inputting a second musical tone control parameter indicative of a tone color.

2. A musical tone generation control apparatus comprising:

(a) holding means having a shape which can be held by one hand of a person;

(b) a plurality of depression-pressure detecting means equipped to said holding means for generating a signal corresponding to a depression-pressure applied thereto by each finger of the hand of the person who holds said holding means;

(c) angle detecting means for generating an angle signal corresponding to a bending angle at a joint portion of the person; and (d) means for generating musical tone control data based on said signal and said angle signal, said musical tone control data controlling a musical tone generating apparatus which is externally provided.

3. A musical tone generation control apparatus according to claim 2 wherein said means includes:

(a) a table for storing data indicative of a corresponding relation between said angle signal and a tone pitch of a musical tone to be generated by said musical tone generating apparatus; and (b) changing means capable of changing said corresponding relation to be stored in said table based on said signal.

4. A musical tone generation control apparatus comprising:

(a) holding means having a shape which can be held by one hand of a person;

(b) a plurality of pressure detectors equipped to said holding means, said pressure detector generating a pressure signal corresponding to a depression-pressure applied thereto by each finger of the hand of the person who holds said holding means;

(c) first means for generating musical tone control data by performing a function assigned to a depressed pressure detector within said plurality of pressure detectors;

(d) second means capable of setting a corresponding relation between each pressure detector and its function to be assigned; and (e) third means capable of changing said corresponding relation in response to an operation of said pressure detector.

* * * * *